United States Patent [19]

Zeldes

[11] Patent Number: 4,508,764

[45] Date of Patent: Apr. 2, 1985

[54] COATING PROCESS EMPLOYS SURFACTANTS

[75] Inventor: Michael D. Zeldes, Hendersonville, N.C.

[73] Assignee: E. I. Du Pont de Nemours and Company, Wilmington, Del.

[21] Appl. No.: 449,744

[22] Filed: Dec. 14, 1982

[51] Int. Cl.[3] ..... B05D 3/00; G03C 1/76

[52] U.S. Cl. ..... 427/296; 427/346; 430/631; 430/636; 430/637

[58] Field of Search ..... 430/631, 636, 637; 427/296, 346

[56] References Cited

U.S. PATENT DOCUMENTS

| | | | |
|---|---|---|---|
| Re. 29,255 | 6/1977 | McDowell | 96/87 R |
| 2,761,791 | 9/1956 | Russell | 117/34 |
| 3,666,478 | 5/1972 | Groh et al. | 96/114.5 |
| 3,754,924 | 8/1973 | De Geest et al. | 96/114.2 |
| 3,775,126 | 11/1973 | Babbitt | 96/67 |
| 3,928,678 | 12/1975 | Jackson | 427/402 |
| 4,272,615 | 6/1981 | Yoneyama et al. | 430/527 |
| 4,292,402 | 9/1981 | Pollet | 430/631 |
| 4,299,188 | 11/1981 | Isayama et al. | 118/412 |
| 4,367,283 | 1/1983 | Nakayama | 430/631 |

*Primary Examiner*—John E. Kittle
*Assistant Examiner*—James J. Seidleck

[57] ABSTRACT

Incorporation of a fluorocarbon and a hydrocarbon surfactant in a photographic silver halide emulsion for high speed slide flow coating increases coating latitude by reducing a disruptive standing wave and allowing broader vacuum pressure ranges. The increased coating latitude is particularly advantageous at coating speeds above 100 meters per minute when the emulsion contains from 0.02 to 2 g of fluorocarbon surfactant per 1.5 moles of silver halide.

7 Claims, 4 Drawing Figures

COATING PROCESS EMPLOYS SURFACTANTS

BACKGROUND OF THE INVENTION

The present invention relates to a process for coating a conveyed long, flexible support (hereinafter referred to as "a web" when applicable) with a liquid-type coating compound.

An example of a coating apparatus which has been extensively employed to coat a liquid-type coating compound (hereinafter referred to as "a coating liquid" when applicable) onto a web is the multi-layer slide bead coating apparatus described in U.S. Pat. No. 2,761,791, Russell et al. In this apparatus a plurality of coating liquids flow down the slide surface, and, at the lower end, strike against a conveyed web so as to form a bead, from which the coating liquids are applied to the web. Accordingly, in this coating apparatus it is essential to maintain the bead stable in order to successfully apply the coating liquids to the web. However, as the coating speed is increased, it becomes more difficult to maintain the bead stable.

In order to overcome this difficulty, an improved coating apparatus was proposed by Jackson in U.S. Pat. No. 3,928,678. This coating apparatus can eliminate the instability of the bead which results as the coating speed is increased. In the conventional coating apparatus, a lip-shaped member is provided at the lower edge of the slide surface for decreasing the speed of the layer of coating liquid flowing down the slide surface in order to increase the thickness of the liquid flow and to thereby stabilize the bead. With such a coating apparatus, particle effect in the coating liquid (appearance of stripes due to irregular coating) is observed, which may be attributed to an increase in the thickness of the layer of coating liquid. However, if one desires to increase the coating speed while the bead is maintained stable, this coating apparatus is unsuitable because the permissible increase in coating speed is not more than about 10%. Even that increase is possible only where the flow rate of coating liquid is relatively high. If the flow rate is relatively low, the permissible increase is sometimes lower than that of the Russell et al coating apparatus.

An object of this invention is to provide a coating apparatus in which all of the above-described difficulties accompanying a conventional coating apparatus have been eliminated and the coating speed can be greatly increased, especially in the case where the flow rate of coating liquid is relatively low. In particular, it is directed to the reduction of coating defects associated with a standing wave in the coating of a silver halide emulsion upon a support.

SUMMARY OF THE INVENTION

The present invention is directed to a process of slide flow coating a layer of silver halide emulsion upon a moving support or web such as polyethylene terephthalate, in which process a stream of emulsion (and optionally one or more other coating liquids) flows onto the moving support, and wherein the stream of emulsion exhibits a standing wave just prior to contacting the moving support, which causes nonuniform coating, ribbing or streaking as defects which are apparent in both developed and undeveloped coating samples, wherein the improvement comprises reducing said standing wave by incorporating in the emulsion a hydrocarbon surfactant such as octylphenoxy polyethoxy ethanol, and an anionic, nonionic or amphoteric fluorocarbon surfactant such as fluorinated alkyl polyoxethylene ethanol. The result is a coating process of increased latitude and better quality, in particular at higher coating speeds.

A particularly useful embodiment of the invention involves coating silver halide emulsions and auxiliary layers on a web at speeds above 100 meters per minute.

DETAILED DESCRIPTION OF THE INVENTION

Figure 1:
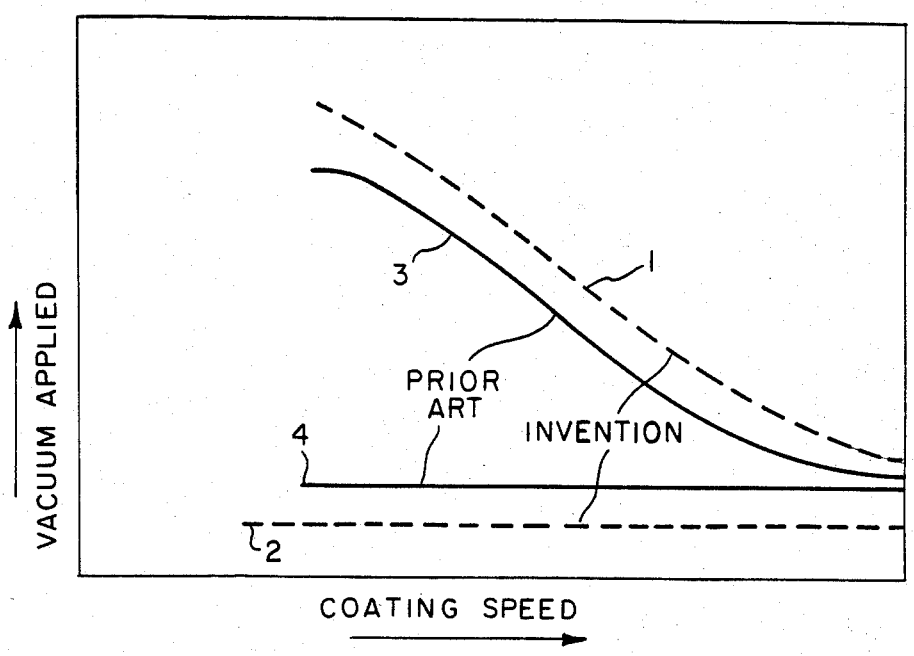
FIG. 1 demonstrates that a limited area of coating operability exists between the minimum and maximum vacuum pressure which can be applied when coating an emulsion upon a support, with the solid lines representing the prior art and the dotted lines representing the present invention.

FIG. 1 depicts the coatability range as a function of vacuum pressure and coating speed. The solid lines 3, 4 illustrate prior art coatings minus the surfactant combination of the present invention. While the range is limited at very low coating speeds there is much greater latitude in the middle speed ranges. As high coating speeds are reached, the vacuum range in which satisfactory coating can be obtained narrows down considerably.

The dotted lines 1, 2 represent comparative results with the present invention. As higher coating speeds are reached, the present invention shows a wider range of operability than the prior art, and the experimental data can be projected to maintain the advantage at even higher speeds than those measured. The trend of the solid lines 3, 4 to neck together, versus the more gradual convergence of the dotted lines, points to the greater flexibility in selection of applied vacuum for the present invention as opposed to the prior art. With the trend to higher and higher speeds the vacuum range which can be used successfully for the prior art is narrow and critical, whereas the present invention allows leeway on either the maximum or minimum side for usable vacuum pressure.

Figure 2:
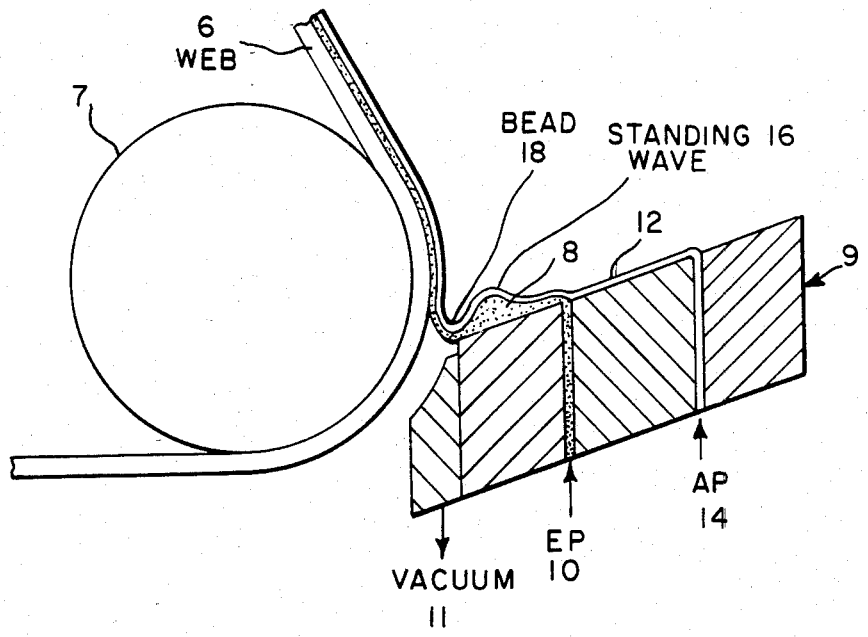
FIG. 2 illustrates the standing wave created in slide bar coating.

FIG. 2 illustrates the standing wave problem. A moving web support 6 driven by roller 7 picks up liquids which have been pumped through slots in a coating bar 9 and flow down to a point where the pressure of vacuum 11 holds the bead 18 so as to enable the web to be uniformly coated. In this example, which would represent a photographic coating, a silver halide emulsion 8 is introduced by EP (Emulsion Pump) 10 and an antiabrasion solution 12 is introduced by AP (Abrasion Pump) 14. While the liquids flow down the bar surface the system dynamics of the moving liquids, moving web, vacuum pressure, and surface tensions all interact to create a liquid standing wave 16 as illustrated. This standing wave acts as a disruptive force on the quality of the coating formed on the surface of the moving web. In particular, the standing wave can disrupt the bead 18 being held by the vacuum pressure exerted by vacuum-forming means.

Figure 3:
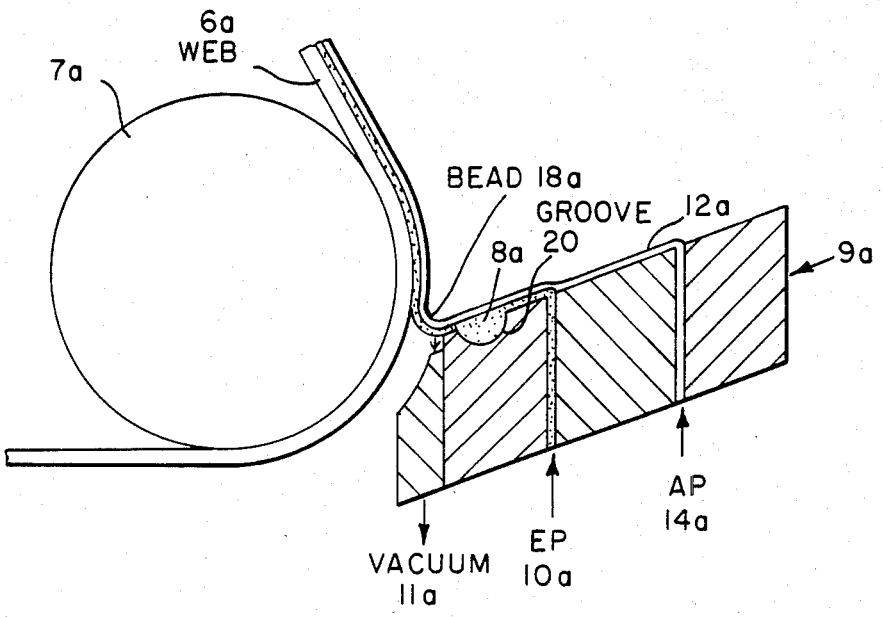
FIG. 3 illustrates the grooved bar of U.S. Pat. No. 4,299,188 as a prior art method of containing the standing wave.

FIG. 3 illustrates the use of the apparatus invention of U.S. Pat. No. 4,299,188 in dealing with the standing wave problem. Here the groove 20 cut into the front portion of the coating bar 9a can fill with a volume of liquid which would otherwise be piled up as shown in FIG. 2. Thus, the flow of the emulsion 8a and antiabrasion solution 12a, supplied by EP 10a and AP 14a respectively, and subjected to vacuum 11a, is relatively smooth and the liquids can be coated on the moving web 6a driven by roller 7a without the disruptive effect of a standing wave. It should be noted, when comparing FIG. 2 and FIG. 3, that the groove 20 in FIG. 3 is of the correct size to accommodate the standing wave 16 illustrated in FIG. 2. This size groove would not be satisfactory for a larger or smaller standing wave. Thus, the invention would require a different apparatus to be used for different coating compositions and even for different coating speeds, since the standing wave is a function of the system dynamics.

Figure 4:
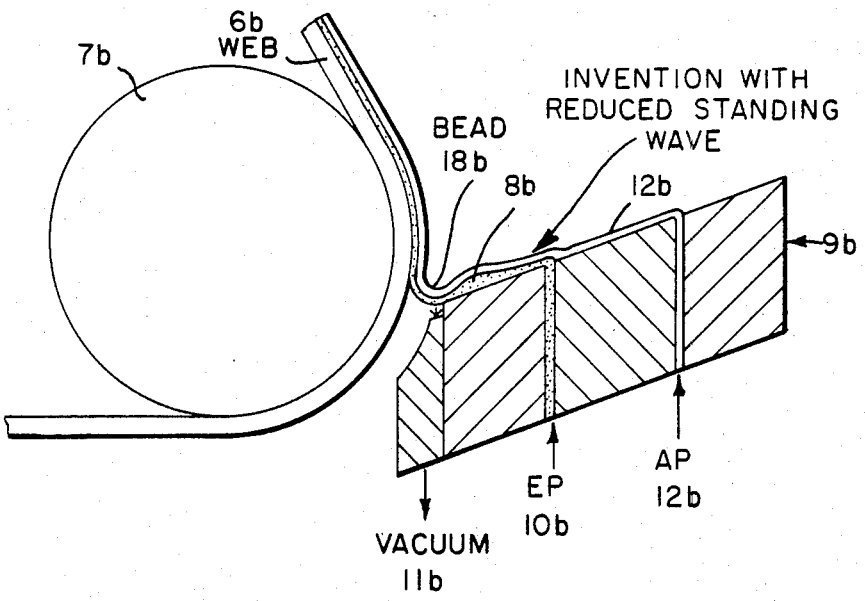
FIG. 4 illustrates the process of the present invention in which the standing wave is reduced by a combination of a hydrocarbon and fluorocarbon surfactant in the emulsion.

FIG. 4 illustrates how the standing wave of FIG. 2 is reduced by incorporating the combination of a hydrocarbon and a fluorocarbon surfactant in the silver halide emulsion 8b and antiabrasion solution 12b; associated elements 9b, 10b, 11b and 12b require no description. The point of FIG. 4 is that without the disturbance of the standing wave the coatings are applied to the moving web 6b, driven by roller 7b, in a uniform manner without disruption of the bead 18b. Thus, the process of the present invention utilizes the superior dynamic surface tension properties of a fluorocarbon surfactant in combination with the solubilizing properties of a hydrocarbon surfactant in providing the advance shown here and in FIG. 1.

In accordance with the present invention, it has been described that the fluorocarbon surfactant possesses the ability to lower static and dynamic surface tension better than other surfactants, and it is this property which enables one to control the standing wave. Under identical circumstances a silver halide emulsion containing hydrocarbon surfactant is limited to a low value of about 28 dynes per cm for static surface tension, whereas with a fluorocarbon surfactant the surface tension can go as low as 20 dynes per cm. The fluorocarbon surfactant can provide silver halide emulsions with lower static surface tension than any hydrocarbon surfactant and this has been found to correlate with dynamic surface tension. The importance of this surface tension advantage is evidenced in the superior properties illustrated in FIG. 1 and FIG. 4 under dynamic coating conditions.

Yet, even with the wider vacuum latitude and the control of the standing wave, the process of the present invention would not be complete without the incorporation of a hydrocarbon surfactant to trap dirt particles. In this respect the hydrocarbon surfactant functions as a detergent to solubilize particles which would otherwise cause coating defects. Thus, it is the combined effects of the hydrocarbon and fluorocarbon surfactants which allow the coating process to give satisfactory quality during high speed coating. The fluorocarbon surfactant is essential to counteract the standing wave, whereas the hydrocarbon surfactant prevents defects which would result from dirt.

To be useful in the process of coating a photographic emulsion, it is essential that the surfactants not have an adverse effect on the photographic properties of either the liquid emulsion or the final coated film. Thus, the surfactants used must not only be satisfactory in terms of surface tension or solubilizing action, but they must be compatible with the emulsion and other auxiliary layers and be sensitometrically inert. That is to say, the surfactant addition must not adversely affect the speed, fog, gradient or aging properties. In addition, the process of the present invention demands that the surfactant additions permit simultaneous coating of two or more liquid layers onto a support at speeds of over 100 meters per minute.

Especially suitable fluorocarbon surfactants which have been found to satisfy the process requirements for the present invention are: Zonyl ®FSN, available from E. I. du Pont de Nemours and Company, and FC-170C available from the 3M Company. These have a fluorinated alkyl polyoxethylene ethanol structure:

$$F(CF_2CF_2)_nCH_2CH_2O(CH_2CH_2O)_m—H$$

where n=2 to 10 and m=5 to 11.

Two other fluorocarbon surfactants were not satisfactory, one because of repellents and static when used in a photographic emulsion (Zonyl ®FSA), and one which was found to be photographically active (Zonyl ®FSB). It is envisioned, however, that excepting cationic surfactants which are known to give coagulation in photographic emulsions, there are other anionic, nonionic or amphoteric fluorocarbon surfactants which could be employed in the present invention.

Especially useful for the hydrocarbon surfactant is Triton ®X-100, available from Rohm and Haas, with the formula:

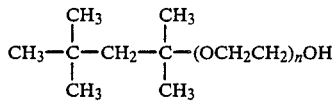

where n=9–10. Other hydrocarbon surfactants which are also useful for the practice of the present invention are: Standapol ®ES-40, available from Henkel Inc., a sodium myreth sulfate of the formula:

$$C_{14}H_{29}(OCH_2CH_2)_5OSO_3^-Na+$$

and Merpol ®SH, available from E. I. du Pont de Nemours and Company, an ethylene oxide condensate of the formula:

$$CH_3(CH_2)_{12}—(CH_2CH_2O)_8OH$$

When used in a gelatino-silver halide emulsion, a useful range is 0.02 to 2.0 g fluorocarbon surfactant, preferably 0.3–0.8 g, per 1.5 mole of silver halide. The corresponding range for the hydrocarbon surfactant is from 0.05 to 1 g surfactant per 1.5 mole of silver halide. When used in a gelatin coat such as an antiabrasion overcoat for the emulsion layer the fluorocarbon surfactant is effective in a range from 0.1 to 2 g, preferably 1–2 g, surfactant per 200 g of gelatin, while the range for the hydrocarbon surfactant is from 1 to 5 g per 200 g of gelatin.

As shown in FIGS. 2, 3 and 4 a vacuum is applied to the underside of the coating bead to stabilize the bead and obtain good coating quality. There is an upper and lower limit of vacuum pressure between which satisfactory coatings can be produced. The upper limit is usually referred to as the maximum vacuum pressure and corresponds to a gross failure characterized by regularly spaced "vacuum" streaks. At the lower limit, or minimum vacuum pressure, the edge of the bead breaks, followed by catastrophic failure of the entire bead. In other words, when the vacuum pressure is too great the coating is cut into ribbons, and when the vacuum pressure is too low the liquid will not make satisfactory contact with the moving support or web.

Usually the measurement of the maxiumu vacuum pressure is reproducible and depends primarily on web speed, web to bar gap, coating thickness, and fluid properties. The minimum vacuum pressure is much less sensitive to these variables. Measurement of the minimum vacuum pressure is more variable because of variations in bar design and system setup which can influence the amount of leakage and edge pressure. Thus, after minimum vacuum pressure has been measured with a particular emulsion and surfactant system, it may be necessary to clean and readjust the coating bar before remeasuring the same emulsion and surfactant system in order to eliminate contamination. If, in the realignment of the coating bar with the web, there are variations from the exact positioning used for the previous measurement, then the minimum vacuum pressure will change. In short, the experimental error involved with the low measurements is high while the experimental error involved with the high measurements is low.

The present invention deals with the dynamics of a coating process. In the bar coating process shown in FIGS. 2, 3 and 4 the fluids are elongated by a factor of ten in passing from the bar to the web. This means that a large amount of fresh surface is created at both the upper and lower meniscus of the bead in a very short time (milliseconds). The effective surface tension in bar coating depends on the time required for the surfactant molecules to migrate to and orient at the interface. This response, in which surfactant molecules may be required to break from a micelle in the bulk of the coating fluid and move to fill in voids in the newly generated surface in a matter of milliseconds, involves dynamic surface tension.

It is well known in measurements of static surface tension that no further layering occurs once sufficient surfactant has been added to reach the critical micelle concentration (CMC). Thus, as more surfactant is added, the only effect is to produce more micelles in the bulk of the fluid and no further surface effect is apparent in the static measurement. But, referring to the factor of ten increase in surface area previously mentioned in the bar coating process, there is a requirement for micelles to rapidly supply about ten new surfactant molecules for every molecule located in the surface at the instant the fluid leaves the bar under the vacuum influence. The dynamic surface properties of surfactant molecules are therefore not obvious from static measurements and are only discernible by actual experimentation. Prior findings at slower coating speeds are not necessarily transferable to higher coating speeds.

The following examples serve to illustrate the practice of the present invention in the field of coating photographic films.

EXAMPLE 1

Twenty portions of high speed negative silver iodobromide emulsion (1.2% iodide) which had been gold-sulfur sensitized, and contained all afteradditions except surfactants, were separated in temperature-controlled and stirred kettles.

Similarly, twenty portions of antiabrasion solution (gelatin overcoat) containing all afteradditions except surfactants were separated in temperature-controlled and stirred kettles.

Surfactant additions were made to the twenty emulsions and twenty antiabrasion solutions to correspond to the compositions indicated in Table 1. Chemical identifications for surfactant names given in the Table are: Triton ®X100: octylphenoxy polyethoxy ethanol, Triton ®X200: sodium salt of polyether sulfonate, Standapol ®ES-40: sodium myreth sulfate, Merpol ®SH: alkyl polyethoxy ethanol, DuPonol ®WAQE: sodium lauryl sulfate, Coneo ®AAS35: sodium dodecyl benzene sulfonate, Duponol ®SP: sodium alcohol sulfate, Alkanol ®XC: sodium alkyl naphthalene sulfate, Duponol ®WN: sodium salts of mixed long chain alcohol sulfate esters. For each test the emulsion and gelatin overcoat were deaereated to eliminate bubble streaks during bar coating. The emulsions had a measured silver analysis of from 9.7 to 10% and the gelatin analyses for the antiabrasion solutions were all approximately 6%. Table 2 contains data for the measured viscosities and surface tensions made prior to coating.

Prior to each test the coating bar was cleaned to avoid cross contamination from other surfactants, and the bar-to-web gap was set at 0.015 cm.

Using the process flow conditions illustrated in FIGS. 2 and 4, each emulsion and antiabrasion solution was bar coated at three different speeds. During these coatings the vacuum pressure was varied until unsatisfactory coating was obtained. The difference in vacuum gauge reading between the low value where failure occurred and the high value where failure occurred is the vacuum pressure range which is given in Table 3.

Examination of the data in Table 3 makes it clear that in every instance a wider vacuum range is obtained with the combination of the present invention than with prior art combinations. For instance, taking the average of the 122 mpm coatings for tests 2 to 10 gives a value of 0.14, whereas the value for tests 12 to 20 is 0.36. Thus, during critical high speed coating the range for vacuum pressure for the invention is more than double that of prior art combinations.

TABLE 1

Composition of Test Coatings
Amounts Added to Emulsion in Grams/1.5 mole AgX
Amounts Added to Abrasion in Grams/200 Grams Gelatin

| | SURFACTANT 1 | | SURFACTANT 2 | |
|---|---|---|---|---|
| TEST | EMUL | ABR | EMUL | ABR |
| 1 | Saponin | | — | |
| | 1.50 | 6.90 | | |
| 2 | Saponin | | Triton ® X-100 | |
| | 1.62 | 6.90 | .135 | 1.30 |
| 3 | Saponin | | Triton ® X-200 | |
| | 1.62 | 6.90 | .840 | 4.20 |
| 4 | Saponin | | Standapol ® ES-40 | |
| | 1.62 | 6.90 | .513 | 1.06 |
| 5 | Saponin | | Merpol ® SH | |
| | 1.62 | 6.90 | 0.500 | 3.00 |
| 6 | Saponin | | Duponol ® WAQE | |
| | 1.50 | 6.90 | 0.750 | 3.00 |
| 7 | Saponin | | Conco ® AAS35 | |
| | 1.50 | 6.90 | 0.788 | 3.15 |
| 8 | Saponin | | Duponol ® SP | |
| | 1.50 | 6.90 | 0.85 | 3.40 |
| 9 | Saponin | | Alkanol ® XC | |
| | 1.50 | 6.90 | 0.75 | 3.00 |
| 10 | Saponin | | Duponol ® WN | |

TABLE 1-continued

| Composition of Test Coatings<br>Amounts Added to Emulsion in Grams/1.5 mole AgX<br>Amounts Added to-Abrasion in Grams/200 Grams Gelatin | | | | |
|---|---|---|---|---|
| | SURFACTANT 1 | | SURFACTANT 2 | |
| TEST | EMUL | ABR | EMUL | ABR |
| | 1.50 | 6.90 | 0.85 | 3.40 |
| 11 | Zonyl ® FSN | | — | |
| | .168 | .67 | | |
| 12 | Zonyl ® FSN | | Triton ® X-100 | |
| | .168 | .67 | .135 | 1.30 |
| 13 | Zonyl ® FSN | | Triton ® X-200 | |
| | .168 | .67 | .840 | 4.20 |
| 14 | Zonyl ® FSN | | Standapol ® ES-40 | |
| | .168 | .67 | .513 | 1.06 |
| 15 | Zonyl ® FSN | | Merpol ® SH | |
| | .168 | .67 | .50 | 3.0 |
| 16 | Zonyl ® FSN | | Duponol ® WAQE | |
| | .168 | .67 | 0.750 | 3.00 |
| 17 | Zonyl ® FSN | | Conco ® AAS35 | |
| | .168 | .67 | 0.788 | 3.15 |
| 18 | Zonyl ® FSN | | Duponol ® SP | |
| | .168 | .67 | 0.85 | 3.40 |
| 19 | Zonyl ® FSN | | Alkanol ® XC | |
| | .168 | .67 | 0.75 | 3.0 |
| 20 | Zonyl ® FSN | | Duponol ® WN | |
| | .168 | .67 | .85 | 3.4 |

TABLE 2

| Viscosity and Surface Tension (38–40° C.)<br>Centistokes and Dynes/cm | | | | |
|---|---|---|---|---|
| | VISCOSITY | | SURFACE TENSION | |
| TEST | EMUL | ABR | EMUL | ABR |
| 1 | 9.3 | 9.1 | 43.1 | 38.2 |
| 2 | 8.5 | 9.6 | 37.9 | 32.3 |
| 3 | 8.5 | 9.9 | 33.0 | 30.5 |
| 4 | 8.6 | 9.8 | 34.0 | 34.8 |
| 5 | 8.2 | 9.7 | 32.0 | 30.7 |
| 6 | 9.7 | 10.8 | 37.1 | 36.9 |
| 7 | 9.9 | 11.0 | 37.0 | 35.9 |
| 8 | 9.3 | 8.9 | 41.9 | 38.1 |
| 9 | 9.5 | 8.7 | 41.5 | 38.2 |
| 10 | 9.3 | 8.8 | 40.2 | 32.8 |
| 11 | 9.8 | 8.8 | 31.0 | 29.0 |
| 12 | 8.3 | 9.3 | 29.5 | 27.0 |
| 13 | 8.3 | 9.7 | 28.0 | 26.7 |
| 14 | 8.2 | 9.9 | 30.8 | 27.9 |
| 15 | 8.2 | 9.4 | 28.2 | 26.8 |
| 16 | 10.0 | 10.6 | 30.3 | 30.2 |
| 17 | 9.5 | 10.7 | 29.0 | 29.9 |
| 18 | 9.1 | 8.8 | 29.1 | 28.6 |
| 19 | 9.2 | 8.7 | 28.8 | 28.0 |
| 20 | 9.0 | 8.8 | 30.8 | 27.8 |

TABLE 3

| Vacuum Range Under Test Conditions | | | |
|---|---|---|---|
| TEST | 76 mpm | 99 mpm | 122 mpm |
| 1 | .25 | .07 | .02 |
| 2 | .50 | .25 | .17 |
| 3 | — | .35 | .25 |
| 4 | .30 | .20 | .15 |
| 5 | — | .37 | .15 |
| 6 | .15 | .25 | .07 |
| 7 | — | .50 | .20 |
| 8 | .15 | .10 | .20 |
| 9 | .25 | .15 | .07 |
| 10 | .40 | .25 | .20 |
| 11 | .35 | .15 | .10 |
| 12 | .40 | .68 | .38 |
| 13 | — | .55 | .37 |
| 14 | — | .50 | .40 |
| 15 | — | .45 | .20 |
| 16 | .70 | .60 | .35 |
| 17 | — | .78 | .47 |
| 18 | .35 | .35 | .30 |
| 19 | .50 | .47 | .30 |

TABLE 3-continued

| Vacuum Range Under Test Conditions | | | |
|---|---|---|---|
| TEST | 76 mpm | 99 mpm | 122 mpm |
| 20 | .60 | .45 | .47 |

The absence of a maximum value at 76 mpm indicates the criterion for the maximum reading, i.e., corrugated, regularly spaced vacuum streaks, was not achieved before complete breakdown of the coating bead.

EXAMPLE 2

Tests were run on the emulsion of test No. 2 of Example 1 to determine the effect of adding Zonyl ®FSN on static surface tension. Results are set forth in Table 4.

TABLE 4

| Grams of FSN per 1.5 mole | Surface Tension (dyne/cm) |
|---|---|
| (none) | 37.3 |
| .30 | 28.1 |
| .60 | 27.0 |
| .90 | 26.6 |
| 1.20 | 25.6 |
| 1.49 | 24.8 |
| 2.24 | 24.6 |
| 3.74 | 24.3 |
| 5.98 | 23.8 |

This illustrates the dramatic effect on static surface tension of small additions of the fluorocarbon surfactant, which becomes minimal as higher amounts are added.

EXAMPLE 3

A test comparison was run similar to tests 2 and 12 of Example 1 except that Zonyl ®FSN was replaced with FC-170C, a fluorocarbon surfactant available from the 3M Co. The amounts of saponin and Triton ®-X-100 remained the same as in Example 1 while the emulsion contained FC170C at 0.123 g per 1.5 mole silver halide and the antiabrasion solution contained FC170C at 0.167 g per 200 grams of gelatin. When bar coated at a speed of 100 mpm the control gave a vacuum range of 0.35 whereas the fluorocarbon and hydrocarbon surfactant combination of the present invention gave a vacuum range of 0.65, or almost double that of the prior art. As with previous tests of Zonyl ®FSN, the sensitometric tests of films containing FC-170C demonstrated utility for photographic purposes.

For purposes of this invention the silver halide emulsions can comprise for example, silver chloride, silver bromide, silver bromoiodide, silver chlorobromide, silver chloroiodide, silver chlorobromoiodide crystals or mixtures thereof. The emulsions may be coarse or fine grain emulsions and prepared by any of the well-known techniques. Similarly, the photographic emulsions and layers prepared in accordance with the invention described herein may be coated on a wide variety of supports. Typical supports include cellulose nitrate film, cellulose ester film poly(vinyl acetal) film, polystyrene film, poly(ethylene terephthalate) film, polycarbonate film and related films or resinous materials.

The photographic emulsions produced in accordance with the practice of this invention may contain the normal addenda useful in photographic silver halides. Typical addenda which may be added are chemical sensitizers, development modifiers, antifoggants and stabilizers, developing agents, hardeners, spectral sensitizers and the like.

We claim:

1. In a process of slide flow coating wherein a stream of silver halide emulsion flows onto a moving support or web under vacuum conditions and, just prior to contact, said stream of emulsion exhibits a standing wave which causes nonuniform coating, ribbing or streaking as defects in the coating the improvement comprising reducing said standing wave by incorporating in the emulsion a hydrocarbon surfactant in combination with a surfactant.

2. The process of claim 1 wherein the hydrocarbon surfactant is octyl phenoxy polyethoxy ethanol, sodium myreth sulphate, or ethylene oxide condensate.

3. The process of claim 1 wherein the emulsion contains from 0.02 to 2 g of fluorinated surfactant per 1.5 mole of silver halide.

4. The process of claim 1 wherein an auxiliary layer is coated simultaneously over the emulsion layer, and contains from 0.1 to 2 g of fluorinated surfactant per 200 g of gelatin.

5. In a process of slide flow coating wherein a stream of silver halide emulsion flows onto a moving support or web under vacuum conditions and, just prior to contact, said stream of emulsion exhibits a standing wave which causes nonuniform coating, ribbing or streaking as defects in the coating, the improvement which comprises reducing said standing wave by incorporating in the emulsion a hydrocarbon surfactant in combination with 0.2 to 2 g of a fluorinated alkyl polyoxyethylene ethanol surfactant per 1.5 mole of silver halide, whereby a coating speed of about 100 meters/minute is maintained, and coating the silver halide emulsion simultaneously with a layer of an auxiliary coating.

6. The process of claim 5 wherein the auxiliary coating is an antiabrasion layer.

7. A coated article made by a process of claim 5.

* * * * *

UNITED STATES PATENT AND TRADEMARK OFFICE

CERTIFICATE OF CORRECTION

PATENT NO. : 4,508,764

DATED : April 2, 1985

INVENTOR(S) : Michael David Zeldes

It is certified that error appears in the above—identified patent and that said Letters Patent is hereby corrected as shown below:

| Column | Line | Correction |
|---|---|---|
| 9 | 12 | after "a" insert -- fluorinated alkyl polyoxyethylene ethanol -- |

Signed and Sealed this

*Seventeenth* Day of *September 1985*

[SEAL]

*Attest:*

*Attesting Officer*

DONALD J. QUIGG

*Commissioner of Patents and Trademarks—Designate*